US005401180A

United States Patent [19]

Muzslay

[11] Patent Number: 5,401,180

[45] Date of Patent: Mar. 28, 1995

[54] CONNECTOR SHORTING SPRING

[75] Inventor: Steven Z. Muzslay, Huntington Beach, Calif.

[73] Assignee: ITT Corporation, Secaucus, N.J.

[21] Appl. No.: 69,793

[22] Filed: Jun. 1, 1993

[51] Int. Cl.[6] ..... H01R 13/703

[52] U.S. Cl. ..... 439/188; 102/202.2; 102/202.3; 200/51.1

[58] Field of Search ..... 439/188, 510; 102/202.2, 202.3, 262; 200/51.1

[56] References Cited

U.S. PATENT DOCUMENTS

| | | | |
|---|---|---|---|
| 3,597,722 | 8/1971 | Walter | 439/510 |
| 3,668,606 | 6/1972 | Walter | 439/510 |
| 3,858,152 | 12/1974 | Cowsert | 439/510 |
| 4,170,939 | 10/1979 | Hoheisel et al. | 102/28 |
| 4,628,818 | 12/1986 | Nilsson | 102/202.2 |
| 4,971,568 | 11/1990 | Cronin | 439/188 |

FOREIGN PATENT DOCUMENTS 0562950 3/1993 European Pat. Off. .

*Primary Examiner*—Gary F. Paumen
*Attorney, Agent, or Firm*—Thomas L. Peterson

[57] ABSTRACT

A conductive spring device (46, FIG. 8 ) is described, which shorts a pair of connector terminals (14, 16) when the connector (12) is not mated to a second connector device (18). The spring device is of the type having a fixed anchor end (50) connected to a first terminal and an opposite contacting end potion (44) which can pivot in a shorting direction (S) to move outwardly (O) and also sidewardly (A) against the second terminal, and which can be forced to pivot in an unshorting direction (U) to move inwardly and sidewardly away from the second terminal. An isolator (92) of insulative material surrounds an inner portion of the second terminal, so when the contacting end portion is in its unshorting position, it cannot move sidewardly against the second terminal. The spring device is formed of a piece of sheet metal with its anchor end (50) having a hole that closely receives the first terminal, the spring device also having a tab (100) which projects inwardly into a slot (102) in the insulative base of the connector to limit pivoting of the spring device about the first terminal.

21 Claims, 5 Drawing Sheets

CONNECTOR SHORTING SPRING

BACKGROUND OF THE INVENTION

An automobile air bag can be deployed by an initiator that is constantly connected to a voltage source, but with the initiator terminals constantly shorted by a sensor. When the sensor detects a collision, its shorting switch opens and allows current to pass through the initiator to deploy the air bag. During vehicle maintenance, a repairman may wish to disconnect the collision sensor from the initiator. In the past, disconnection would lead to firing of the initiator and deployment of the air bag. Accordingly, many prior air bag systems have been constructed to prevent repairmen from disconnecting the connector from the initiator, which hampers repairmen.

The connector can be made disconnectable from the initiator, by providing a shorting device that automatically shorts the terminals of the initiator when the connector is disconnected from the initiator. Such automatic shorting devices are known, with U.S. Pat. No. 4,971,568 by Cronin showing one example, wherein a leaf spring pivots up and against a terminal to ground it, until a mating connector pushes down the leaf spring. However, in a critical application such as an air bag system, any shorting device must have great reliability, especially in assuring that it does not inadvertently short the terminals when the sensor connector has been connected to the initiator. Such inadvertent shorting would result in the air bag not deploying in the event of a crash. A shorting device which was of high reliability, especially in assuring that a pair of terminals are not shorted when two connectors mate, would be of considerable value.

SUMMARY OF THE INVENTION

In accordance with one embodiment of the present invention, a connector system is provided which includes a shorting spring device that shorts a pair of connector terminals, and that is reliably moved to a position where it does not short the terminals when the connector mates with another connector. The spring device has an anchor end permanently connected to the first terminal, and has a contacting end portion which pivots in shorting and unshorting directions against and away from the second terminal. To prevent accidental shorting when the connectors are mated and the contact end portion has been moved inwardly to its unshorting position, an isolator of dielectric material is provided that surrounds an inner portion of the second terminal, with the contacting end portion lying around the isolator.

The spring device can be formed of a piece of sheet metal with its anchor end having a hole receiving the first terminal, and with the sheet metal forming a tab extending inwardly into a slot in the base. The slot limits rotation of the spring device about the first terminal. The contacting end portion of the spring device can include a large aperture through which the second terminal projects. The aperture results in the contact end portion having a pair of arms on laterally opposite sides of the second terminal. The arms are connected by a laterally extending leg that forms a contact location that will engage the second terminal. The anchor end of the spring device can be rigidly fixed to the first terminal by forming slots that leave a pair of abutments, and with one of the abutments initially extending at an incline but being pressed down to penetrate into the surface of the first terminal.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
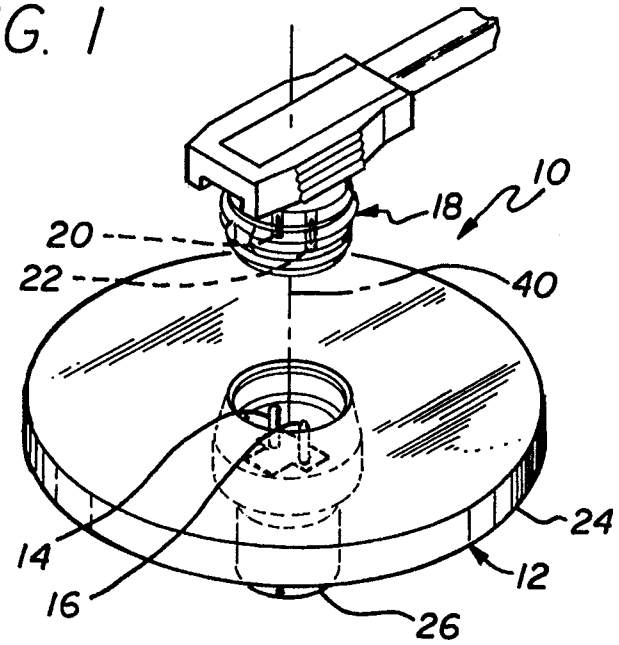
FIG. 1 is an isometric view of a connector and connector device of the present invention.

FIG. 1 illustrates a connector assembly 10 which includes a receptacle connector 12 having a pair of terminals 14, 16, which mates with a plug connector, or connector device 18 that has a pair of corresponding terminal devices 20, 22. The particular connector includes a metal plate 24 that holds an initiator 26 that is used to inflate an air bag in an automobile. The connector device 18 connects to circuitry that fires the initiator, such as a sensor that senses a collision.

Figure 3:
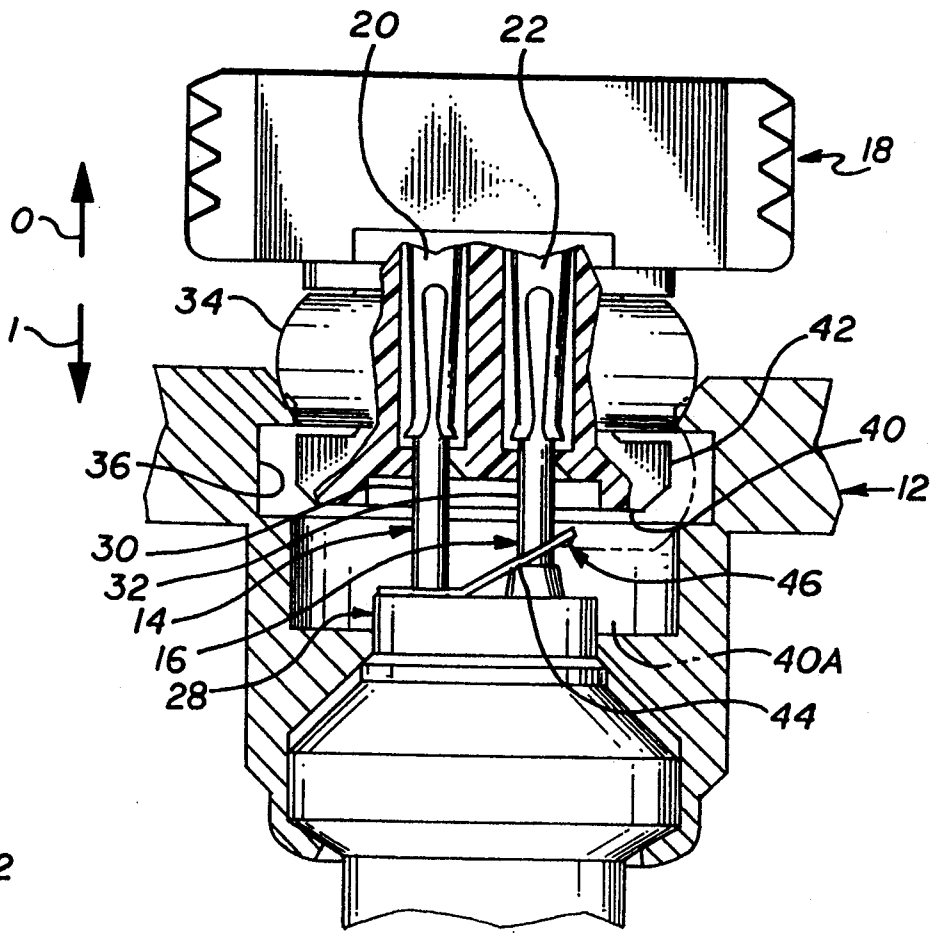
FIG. 3 is a sectional view of the connector system of FIG. 1, with the connector and connector device in a partially mated configuration.
Figure 2:
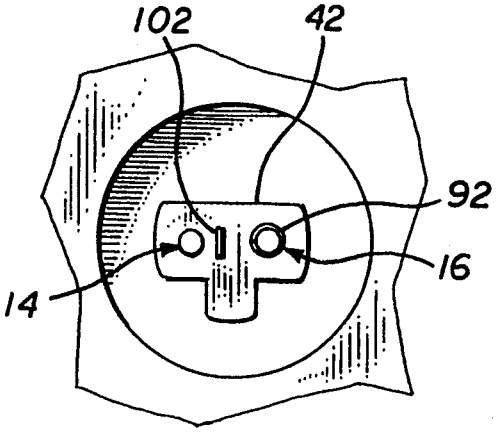
FIG. 2 is a plan view of the connector of FIG. 1, but without the spring device in place.

FIG. 3 shows the plug and receptacle connectors 12, 18 after they have partially mated. The terminals 14, 16 have mounted ends fixed in an insulative housing or base 28 of the connector. The terminals have free ends 30, 32 whose outer tips touch the terminal devices 20, 22 of the connector device at the beginning of mating as shown in FIG. 3. When the connector 18 is pushed down, a snap ring 34 on the connector device will snap into a groove 36 of the receptacle connector. The lower end 40 of an insulative housing 42 of the connector device will then move down to the position 40A. In moving down, the insulative housing will depress a contacting end portion 44 of a spring device 46. Such depression of the contacting end portion in an inward direction I will move the spring device out of engagement with the second terminal 16.

Figure 5:
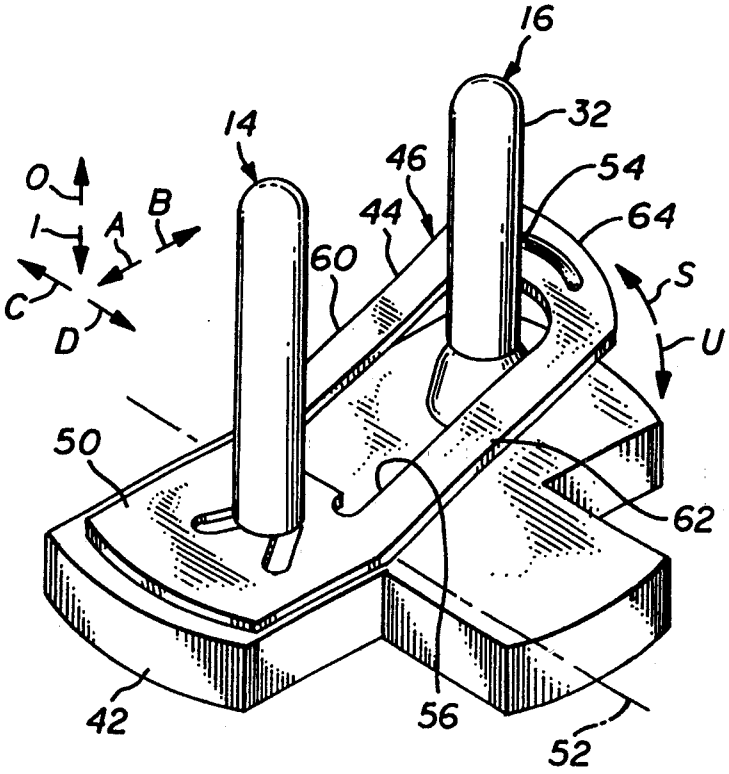
FIG. 5 is an isometric view of a portion of the connector of FIG. 3.

As shown in FIG. 5, the spring device 46 has an anchor end 50 which is anchored in place and connected to the first terminal 14. The contacting end portion 44 pivots largely about a pivot axis 52 so the end portion can move in a shorting direction S and an opposite unshorting direction U. When the contacting end portion 44 is not pushed inwardly in direction I, it pivots in the shorting direction S until a contact location 54 on the contacting end portion engages, or contacts, the outer end portion 32 of the second terminal 16. The spring device 46 is formed of sheet metal, and the contacting end portion 44 forms a large aperture 56, with the second terminal 16 projecting through the aperture. The aperture results in the contacting end portion having a pair of opposite arms 60, 62 that extend largely in longitudinal directions A, B along which the terminals 14, 16 are spaced. The arms are laterally spaced in lateral directions C, D, with arm ends opposite the anchor end being connected together by a laterally extending leg 64. The contact location 54 which engages the second terminal, lies on the leg 64.

Figure 8:
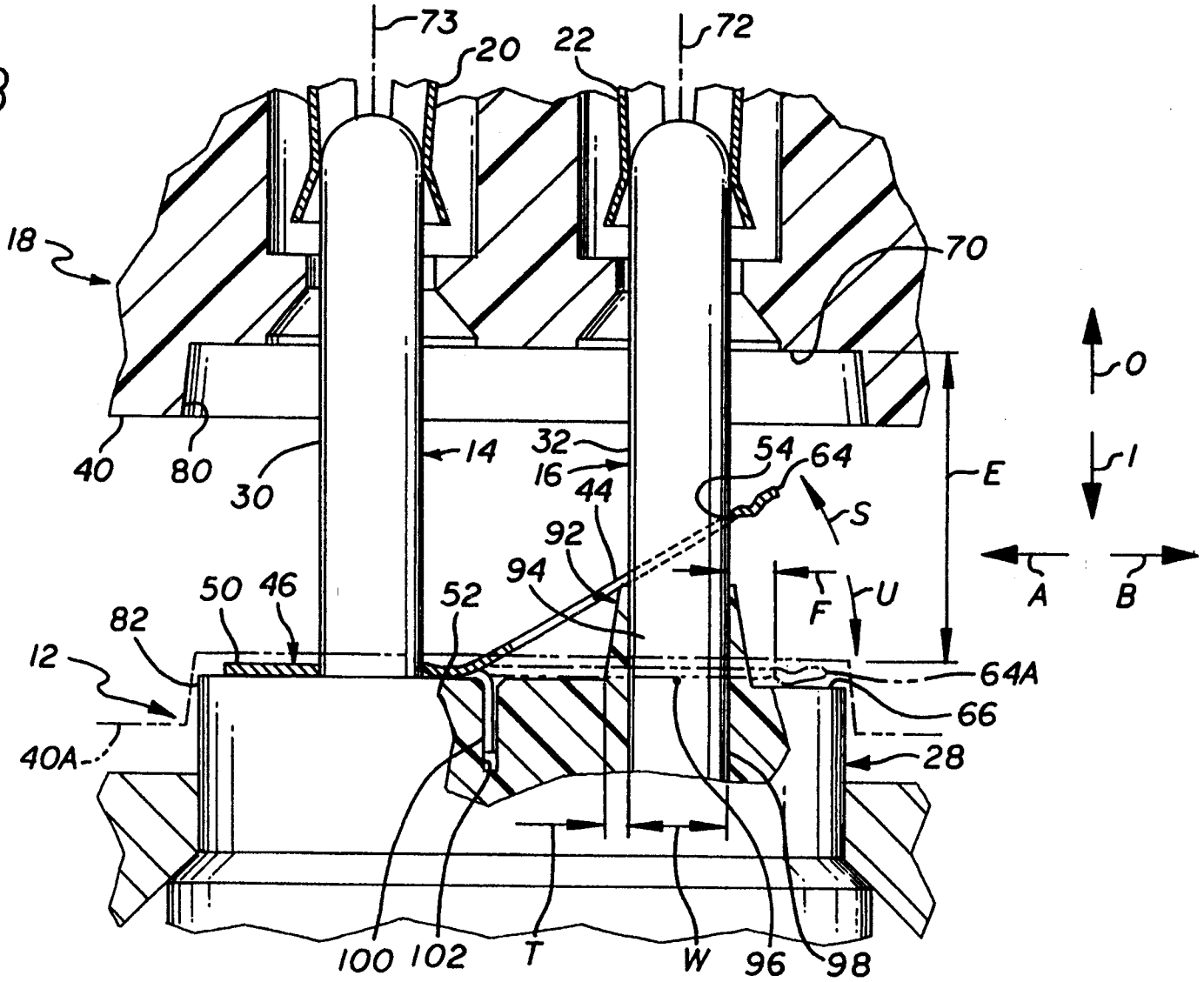
FIG. 8 is an enlarged view of a portion of FIG. 3.

FIG. 8 shows the plug connector device 18 as it begins to mate with the receptacle connector 12. The connector device will move in the inward direction I by a distance E before it becomes fully mated. During such inward movement, an inwardly-facing wall 70 on the connector device will engage the leg 64 of the spring device and push it inwardly. The leg 64 of the contacting end portion will pivot in the unshorting direction U until it reaches the fully unshorted position shown at 64A where it lies adjacent to the outer surface 66 of the base 28. During such unshorting movement, the contact location 54 not only moves inwardly, but also sidewardly in the lateral direction B so it moves away from the axis 72 and cylindrical outer surface of the second terminal 16, by a distance F. Conversely, when the connector device unmates, the spring bias of the spring device causes the contacting end portion 44 and leg 64 to pivot in the shorting direction S, wherein the contact location 54 not only moves outwardly in direction O, but also longitudinally in the direction A until it engages the second terminal. It is noted that the plug housing 42 of the connector device has a recess or keyway 80 which receives an outer part or key 82 of the insulative base 28.

Figure 6:
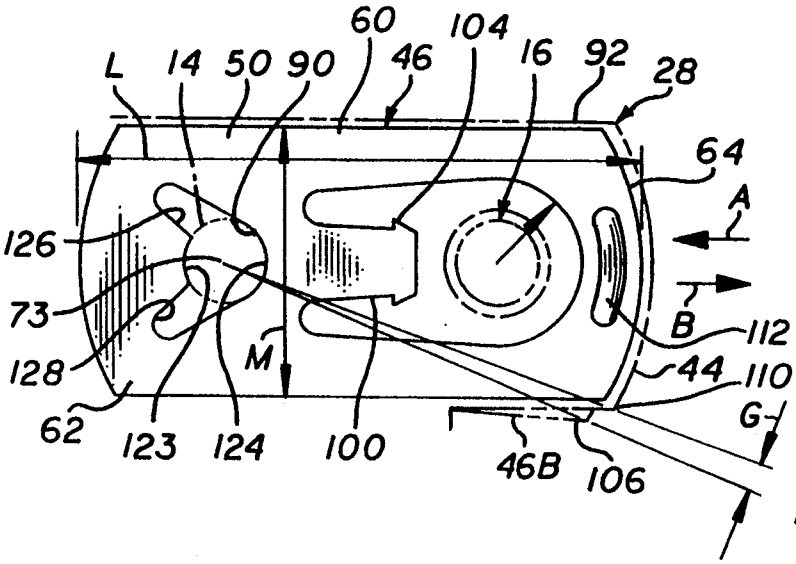
FIG. 6 is a plan view of the spring device of the connector of FIG. 5, shown prior to bending of the tab thereof, and showing, in phantom lines, the position of the base.

As shown in FIG. 6, the anchor end or end portion 50 of the spring device 46 has a hole 90 that closely receives the first terminal 14. The walls of the hole 90 make an electrical connection between the first terminal and the spring device, and also help position the spring device. However, it is still possible for the spring device to pivot about the axis 73 of the first terminal. Unless precautions were taken, it might be possible for the spring device to pivot far enough that one of the arms 60, 62 could touch the cylindrical outer surface of the second terminal 16, even when the contacting end portion had been pivoted to its fully unshorted position. As discussed above, such a touching, which results in shorting the two terminals, could be disastrous, in that such shorting would probably not be apparent until it caused failure of the air bag to deploy in a collision. Applicant takes several steps to prevent such accidental touching.

In accordance with the present invention, applicant provides an isolator 92, shown in FIG. 8, which surrounds an inner part 94 of the second terminal free end portion 32. Applicant considers the terminal free end portion 32 to be the part that extends outwardly from a location 96 where the contacting end portion at leg 64A lies in its fully unshorted position. Each terminal also has an anchored part 98 lying in the base. The base 28 is wide inward of the location 96, so the contact end portion cannot pivot any further in the unshorting direction inward of the location 96. The isolator 92, which is formed of dielectric material, provides a barrier against contact of terminal 16 with either of the arms 60, 62, if the spring device should pivot about the axis 73. The isolator 92 is preferably molded as part of the base 28, although it can be a separate element.

The isolator 92 has a small radial thickness T, to avoid interfering with pivoting of the contact end portion in the unshorting direction. The thickness T is preferably less than the width W of the terminal free outer end portion, and is desirably less than one-half W. Applicant prefers to taper the isolator so it is of progressively greater thickness at more inward locations. As a result, if the spring device pivots about axis 73 to a position where there is interference with the isolator, then as the contacting end portion pivots in the unshorting direction, the isolator will tend to realign the spring device. The isolator will realign the spring device so it is closer to the desired position wherein the inner surfaces of the arms which form the walls of the aperture 60, are equally spaced from the second terminal.

Another way in which applicant avoids unwanted pivoting of the spring device about axis 73, is to provide a tab 100 which is bent to extend inwardly, and which is closely received in a slot 102 formed in the base 42. The tab limits pivoting of the spring device about the first terminal axis 73. The tab therefore further prevents the spring device from engaging the second terminal when the two connectors are fully mated. Applicant prefers to form a pair of barbs 104 on the tab, which are bent slightly out of the plane of the rest of the tab. The barbs dig into the plastic base 28 and better anchor the spring device so it lies close to the base. It is noted that the tab is spaced only a moderate distance from the first terminal axis 73, so it is still possible for the spring device to pivot about the first terminal axis 73.

Applicant further assures that the spring device will lie close to its desired position, shown in solid lines in FIG. 6. If the spring device pivots by an angle G of more than 10° and preferably if it pivots by only about 5°, to the position 46B, a side edge 106 of the spring device will overhang a side location 110 of the key formed by the base 28. In that event, when the connector device is mated with the connector, the inclined side walls of the recess or keyway 80 (FIG. 8) of the connector device housing will tend to press the side edge 106 of the spring device back towards the desired position shown in solid lines in FIG. 6.

The provision of two arms 60, 62 to support the leg 64, provides some leg stability. However there is still a possibility that the leg 64 will bend and bring the legs 60, 62 closer together and thereby increase the possibility that one of them will inadvertently touch the second terminal. To avoid this, applicant provides a depression or deformation 112 in the leg 64, with the leg portion in the depression 112 being deformed out of the plane of the rest of the leg 64. The depression, which is shown in the middle of the leg but which can lie along an edge, greatly strengthens the leg against bending about an imaginary axis extending in the longitudinal directions A, B. Thus, applicant provides several ways to avoid unwanted shorting of the terminals when the connectors are fully mated. It should be noted that the spring device 46 may be very small. A spring device constructed by applicant for an automotive air bag initiator, has an overall length L of only one-quarter inch, so several features of the spring device are of almost microscopic dimensions. The provision of several means to keep the spring device in its preferred alignment position, reduces the possibility of a catastrophic shorting (which would prevent an air bag from deploying in a collision).

Figure 7:
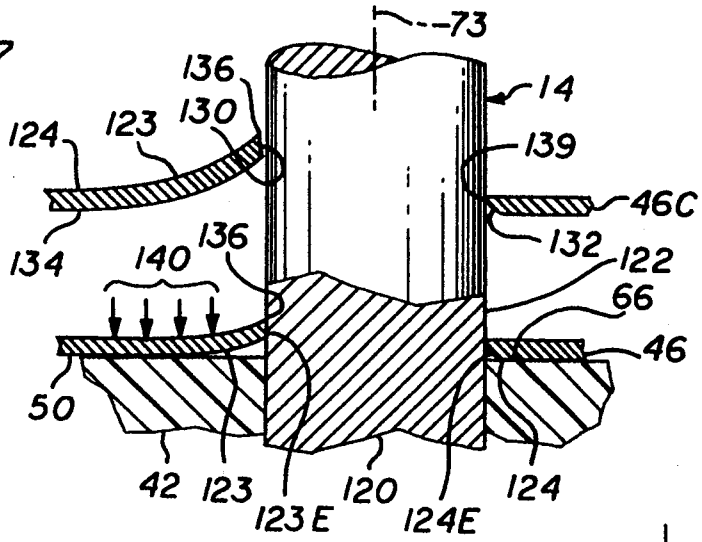
FIG. 7 is an enlarged sectional view of the first terminal of the connector of FIG. 5, showing the manner in which the anchor end of the spring device is installed.

As shown in FIG. 7, each terminal such as the first one 14 is preferably formed with an interior 120 of brass and with a gold plating 122 around the brass to avoid corrosion and assure good electrical connections. Applicant constructs the anchor end 50 of the spring device so it has two abutments 123, 124 that can abut largely opposite sides of the first terminal, to securely hold the anchor end to the first terminal and assure a good electrical connection therewith. As shown in FIG. 6, the hole 90 in the anchor end includes two slots 126, 128 that results in the two abutments 123, 124.

Referring again to FIG. 7, it can be seen that each abutment has an end 123*e*, 124*e* with a rounded inner corner 130, 132 adjacent to the inner face 134 of the spring device, and the first abutment has a sharp corner 136 at its outer face. The rounded corners 130, 132 are provided to prevent the spring device from scratching off the softer gold on the terminal 14 as the spring device is installed. In FIG. 7, the spring device at 46C shows it during installation, while the spring device at 46 shows it fully installed. It can be seen that the first abutment 123 is in the form of a finger that extends at an outward incline at locations progressively closer to the first terminal axis 73. When the spring device has been pushed down, applicant installs a tool around the first terminal 14 and presses down on the tool to firmly depress the finger region 140. This causes the sharp corner 136 to "dig in" or penetrate into the first terminal, through the gold layer. This is because the distance between the adjacent corners 136, 139 on the abutments is less than the width of the first terminal, if the first abutment 122 is bent down to lie on the same plane as the second one. The penetration serves to firmly anchor the spring device to the first terminal, to assure reliable electrical connection therewith, as well as to resist turning of the spring device about the first terminal.

Figure 4:
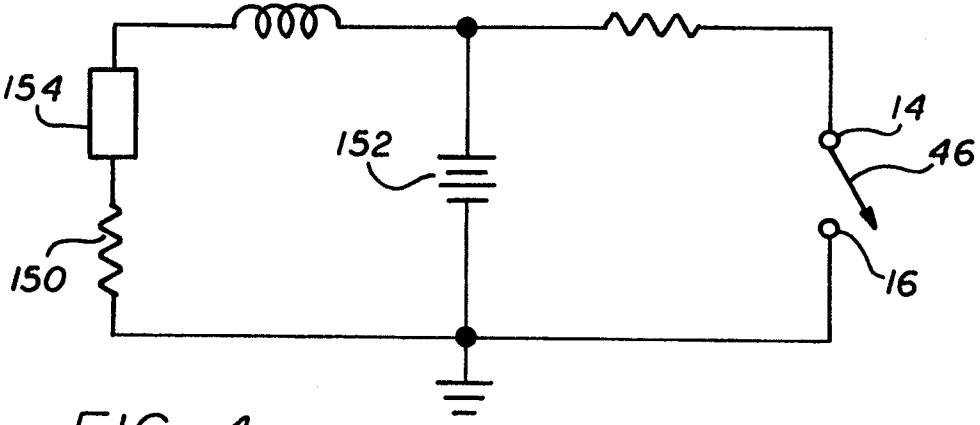
FIG. 4 is a schematic view of the circuitry of an air bag system which includes the connector assembly of FIG. 1.

FIG. 4 is a schematic diagram of one example of an initiator circuit, where a resistor 150 represents the resistance of the initiator charge, and a voltage source 152 tends to apply current through the initiator to fire it. A collision sensor 154 comprises a switch which closes in the event of sudden deceleration, to allow current from the voltage source 152 to pass through the initiator 150 and fire it. When the spring device 46 shorts the terminals 14, 16, sufficient current cannot flow from the voltage source to fire the initiator charge.

Applicant has designed a spring device and connector system of the construction shown in FIGS. 1–8. The spring device 46 was constructed of beryllium copper sheet metal having a thickness of 4 mils (one mill equals one thousandth inch), or 0.10 millimeter. The spring device had an overall length L (FIG. 6) of 0.242 inch (6.15 mm) and width M of 0.120 inch (3.05 mm). The other dimensions are relative to those stated, as shown in FIGS. 6 and 8. Each of the terminals around which the spring device was mounted, had an outside diameter of 0.040 inch (1.00 mm).

Figure 9:
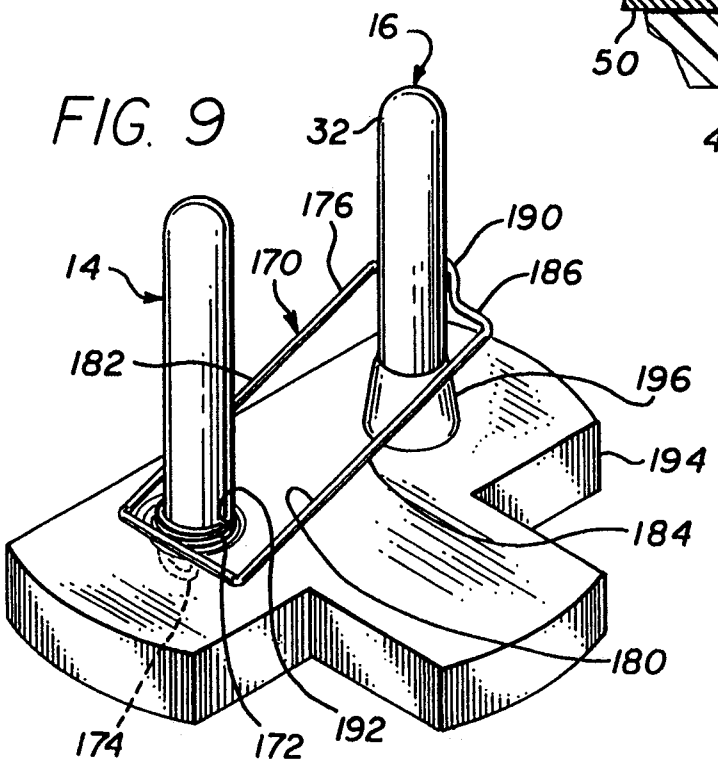
FIG. 9 is an isometric view of a connector constructed in accordance with another embodiment of the invention.

FIG. 9 shows a spring device 170 formed of a length of spring wire, instead of being formed of sheet metal. A spring wire has opposite ends 172, 174, and has at least one turn of a coil at each end, and preferably a plurality of turns. The spring device also has a contacting end portion 176 forming a large aperture 180 and forming a pair of arms 182, 184 with their ends connected by a transverse leg 186. The leg has a curved center 190 that closely surrounds the second terminal 16 when the spring device is in its shorting position. One of the coiled ends 174 lies in a hole 192 formed in the base 194 of the connector. An insulative isolator 196 surrounds an inner part of the second terminal free end portion 32.

Figure 10:
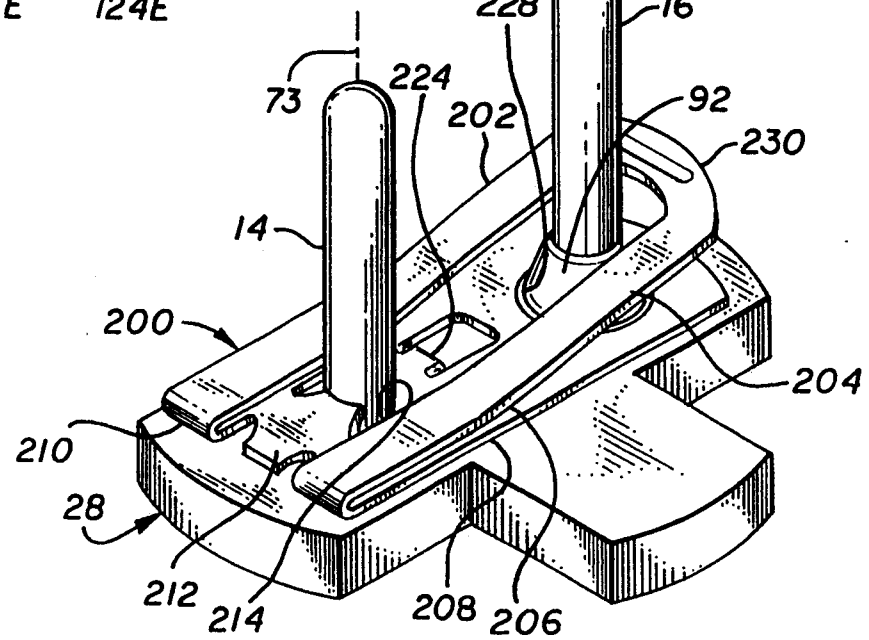
FIG. 10 is an isometric view of a connector constructed in accordance with another embodiment of the invention.
Figure 11:
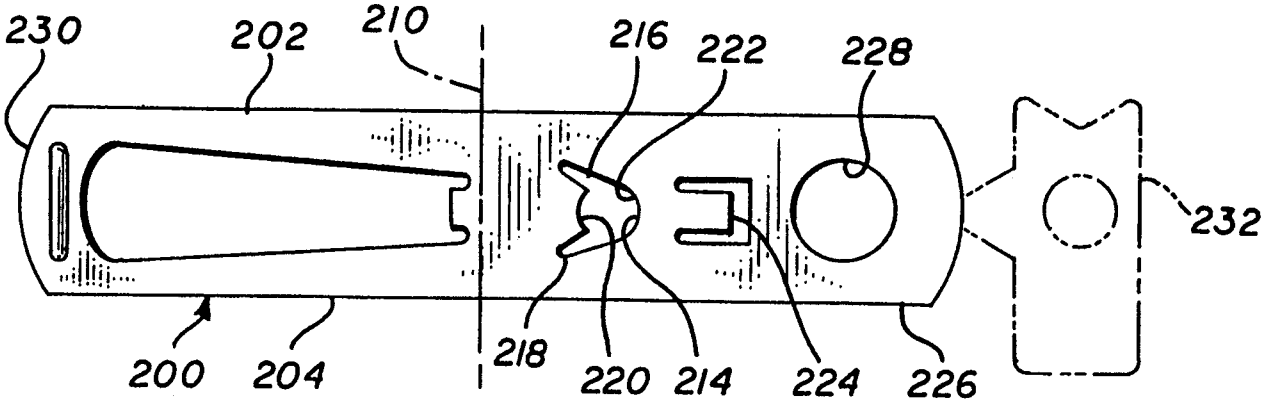
FIG. 11 is a plan view of the spring device of the connector of FIG. 10, shown prior to bending the spring device to the configuration of FIG. 10.
Figure 12:
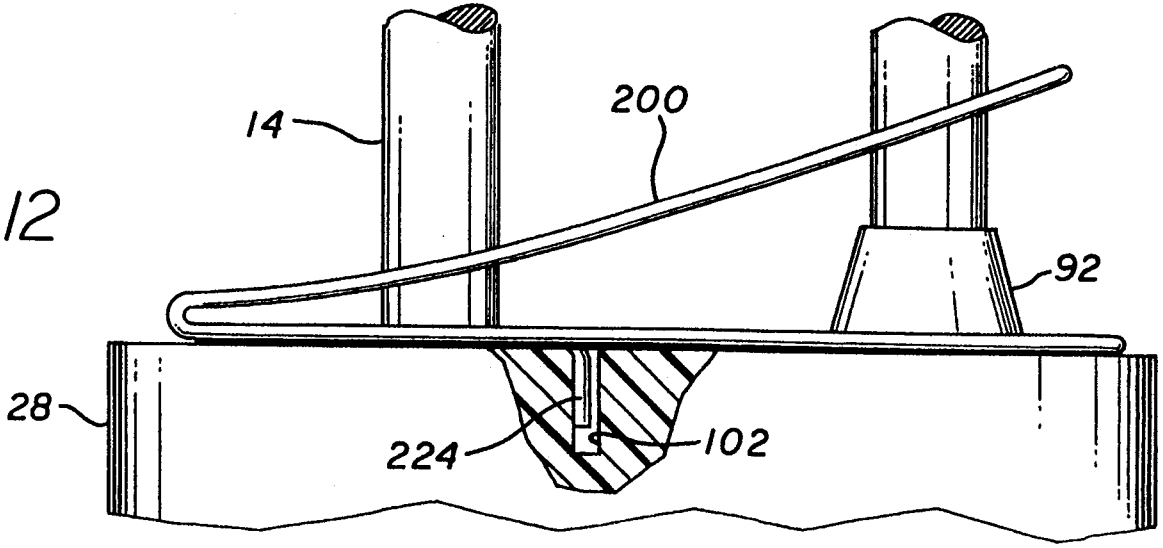
FIG. 12 is a side view of the connector of FIG. 10.

FIGS. 10–12 show a spring device 200 which is largely similar to that of FIGS. 1–8, but which results in longer spring arms 202, 204 for more resilience. The base 28 is of the same construction. The device includes outer and inner parts 206, 208 connected at a substantially 180° fold at 210. An anchor end 212 is formed in the lower part, and includes an anchor hole 214 with slots 216, 218 that result in two abutments 220, 222 that engage the terminal 14. The lower part includes a tab 224 which is received in a slot 102 of the base. The lower part also includes an extension 226 with an opening 228 (which could be a slot) that receives the isolator 92. As a result, walls of the opening lie on opposite sides of the isolator and further stabilize the rotational position of the device about the axis 73 of the first terminal 14.

The bendable arms 202, 204 extend along substantially the entire length of the upper part, with the arm ends connected by a leg 230. FIG. 11 shows the device after it has been blanked from a large sheet of metal, but before the bending operations. The carrier which connects numerous spring devices is indicated at 232.

Thus, the invention provides a connector system and a shorting spring device for shorting a pair of terminals of a connector when that connector is not mated to another one. The spring device includes an anchor end which is anchored in place and a contacting end portion which can pivot in shorting and unshorting directions wherein it moves outwardly and against a second terminal, and inwardly and away from the second terminal. An isolator of dielectric material can surround an inner portion of the second terminal outer end portion. The isolator prevents the contact end portion of the spring device from shifting sidewardly and touching the second terminal when the contacting end portion has been pivoted to its unshorting position. The contacting end portion, which is the portion that pivots in the shorting and unshorting directions, can include a large aperture through which the second terminal projects. The aperture forms a pair of parallel arms extending largely in a longitudinal direction and having ends joined by a laterally extending leg. The two arms stabilize the position of the leg which forms a contact location that engages the second terminal. The spring device can be formed of sheet metal with a hole that closely receives the first terminal and with a tab extending inwardly into the insulative base to limit pivoting of the spring device about the first terminal. The anchor end portion can have slots extending from the hole that closely surrounds the first terminal, to form at least two abutments spaced about the hole. Both abutments preferably have rounded inner corners to avoid scratching the first terminal during installation, and with one of the abutments preferably having a sharp outer corner which digs into the first terminal. The spring device can be formed of a length of spring wire, preferably with coiled ends tightly engaging the first terminal. Of course, the connectors can have other terminals, although those used for automotive air bag systems generally have only two terminals.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A connector system that includes a connector and a connector device that can mate, said connector device having an insulative housing and a pair of terminal devices, and said connector having an insulative base and first and second terminals that have anchored parts anchored to said base and free end portions that extend outwardly from said base, wherein said connector includes an electrically conductive spring device having an anchor end portion connected to said first terminal and having a contacting end portion which can pivot in opposite shorting and unshorting directions, wherein when said contacting end portion pivots in said shorting direction it moves both outwardly and toward said second terminal until a contact location on said contacting end portion engages said second terminal, and wherein said housing pushes inwardly against said contacting end portion when said connector and connector device mate, to force said contacting end portion to pivot in said unshorting direction wherein said contact location moves both inwardly and away from said second terminal, characterized by:

an isolator of insulative material which lies largely around an inner part of said second terminal free end portion to prevent said contacting end portion of said spring device from touching said second terminal when said connector and connector device are fully mated and said contacting end portion has been fully pivoted in said unshorting direction.

2. The connector system described in claim 1 wherein:

said isolator has an inner location that lies beside said contact location when said contacting end portion has been fully pivoted in said unshorting direction, said isolator inner location having a thickness less than the width of said second terminal at said inner location.

3. The connector system described in claim 1 wherein:

said isolator is tapered in width, with said isolator having an outer end of least width.

4. The connector system described in claim 1 wherein:

said spring device comprises a piece of sheet metal, with said anchor end portion having a hole which closely receives said first terminal;

said base has a slot, and said spring device has a tab which projects inwardly into said slot, to limit pivoting of said spring device about said first terminal.

5. The connector system described in claim 1 wherein:

said spring device is formed of sheet metal, and said contacting end portion has an aperture and forms opposite arms that lie on laterally opposite sides of said second terminal and also forms a largely laterally extending leg that connects said arms and that lies on a side of said second terminal that is opposite to said first terminal;

said leg having an elongated depression extending in a direction along the length of said leg, to resist bowing of the contact end portion.

6. The connector system described in claim 1 wherein:

said spring device comprises a piece of sheet metal, and said anchor end portion has a hole which closely receives said first terminal;

said anchor end portion having a plurality of slots extending from said hole and forming a plurality of separate terminal abutments spaced about said hole each having inner and outer faces and each having an end that engages said first terminal, with said end of each abutment forming a rounded corner portion at said inner face, and with at least one of said abutments having a sharp corner at said outer face which penetrates into said first terminal.

7. The connector system described in claim 1 wherein:

said base of said connector has an outer surface portion forming a key with opposite side locations on opposite sides of said second terminal, and said housing of said connector device having a recess forming a keyway that closely receives said key as said connector and connector device mate;

said contact end portion of said spring device has opposite edges that lie near enough to said opposite side locations of said key, that each of said spring device edges will overhang a corresponding one of said key side locations if said spring device is turned more than 10° from a desired position wherein said spring device edges are equally spaced from said key opposite side locations.

8. The connector system described in claim 1 wherein:

said spring device comprises a length of spring wire, with a portion of said wire forming said contacting end portion extending in a loop around said second terminal, with said wire portion biased in said shorting direction but being pivotal in said unshorting direction to a position substantially against said base.

9. The connector system described in claim 1 wherein:

said spring device comprises a length of spring wire which has at least one turn that forms said anchor end portion and that is tightly wound about said first terminal to anchor said wire to said first terminal, said wire extending in a loop about second terminal, with said loop being pivotable to pivot in said shorting and unshorting directions.

10. The connector system described in claim 1 wherein:

said spring device includes outer and inner parts connected at a substantially 180° fold which lies on a side of said first terminal which is opposite said second terminal, said inner part forming said anchor end portion and said outer part forming said contacting end portion and being free of restraint except at said fold to thereby provide a long beam.

11. The connector system described in claim 10 wherein:

said inner part includes an opening forming opening walls that lie on opposite sides of said isolator.

12. A connector which has an insulative base and first and second terminals that project outwardly from a surface of said base and which are constructed to mate with terminal devices of a mating connector device which has a housing that will closely approach said base surface when said connectors mate, wherein said terminals must be continually shorted except when said connector is mated to said connector device, comprising:

a spring device which is formed of sheet metal and which has an anchor end with a hole that closely receives said first terminal, said spring device having a contacting end portion which can move partially in said outer direction and against said second terminal, but which is pressed by said housing of said connector device in said inner direction and out of contact with said second terminal when said connector device mates with said connector;

said base has a slot, and said spring device has a tab that extends inwardly into said slot.

13. The connector described in claim 12 including:

an isolator of dielectric material lying about a portion of said second terminal, which said contacting end portion substantially lies about when said contacting end portion is in its innermost position when said connector and connector device are mated, said isolator having an outer end lying rearward of the location where said contacting outer end moves against said second terminal.

14. A connector comprising:

an insulative base:

a plurality of terminals mounted in said base and having free end portions extending in an outward direction from said base;

a spring device which is formed of sheet metal and which has an anchor end portion anchored to a first of said terminals and a contact end portion which can engage a second of said terminals;

said anchor end portion having a plurality of slots extending from said hole and forming a plurality of separate terminal abutments spaced about said hole each having inner and outer faces and each having an end that engages said first terminal, with said end of each abutment forming a rounded corner portion at said inner face.

15. The connector described in claim 14 wherein:

at least one of said abutments has a terminal engaging end that forms a sharp corner at said outer face and that penetrates into said first terminal.

16. The connector described in claim 14 wherein:

said base has a slot, and said spring device has a tab which projects inwardly into said slot, and which limits pivoting of said spring device about said first terminal.

17. A connector which has an insulative base and first and second terminals that are longitudinally spaced apart and that project outwardly from a surface of said base and which are constructed to mate with terminal devices of a mating connector device which has a housing that will closely approach said base when said connectors mate, wherein said longitudinal and outward directions are normal to each other and to a lateral direction, wherein said terminals must be continually shorted except when said connector is mated to said connector device, comprising:

a spring device which includes inner and outer parts connected by a fold, said inner part being anchored to said first terminal and said fold lying on a side of said first terminal which is opposite said second terminal, said outer part being free of restraint except at said fold and being biased to move largely outwardly but being positioned to be deflected inwardly by said second connector device during mating, with said outer part having a contact location lying on a side of said second terminal opposite said first terminal, said contact location moving outwardly and toward said second terminal and eventually against said second terminal, as said outer part moves outwardly.

18. A method for constructing a connector that has an insulative base and a pair of terminals mounted in the base and having free end portions that extend outwardly from the base, and that includes a spring device connected to said first terminal and having a contacting end portion that can move outwardly and also in a sideward direction that is perpendicular to said outward direction toward said second terminal to a shorting position to engage a location on said second terminal, and wherein said contact end can move inwardly and also sidewardly away from said terminal to an unshorted position, wherein the method safeguards against said contacting end portion touching said second terminal when it has moved to said unshorted position, characterized by:

forming said base with an isolator that extends around an inner portion of said terminal free end portion, but which has a thickness no more than the width of said second terminal, to form a barrier that prevents said contacting end portion in said unshorted position from moving sidewardly but not outwardly and touching said second terminal, while avoiding interference with movement of said contact end to said unshorting position.

19. The method described in claim 18 including:

forming said base with an inwardly extending slot;

forming said spring device of sheet metal, with walls forming a hole and with a tab that extends at substantially a right angle from an adjacent portion of said sheet metal;

moving said spring device so the walls of said hole receive said first terminal to connect to said first terminal and to prevent sideward translation of said spring device, and moving said tab inwardly into said slot, to limit pivoting of said spring device about said first terminal.

20. A connector which has an insulative base and first and second terminals that are longitudinally spaced apart and that project outwardly from a surface of said base and which are constructed to mate with terminal devices of a mating connector device which has a housing that will closely approach said base when said connectors mate, wherein said longitudinal and outward directions are normal to each other and to a lateral direction, wherein said terminals must be continually shorted except when said connector is mated to said connector device, comprising:

a spring device which is formed of sheet metal, said spring device having an anchor end with a hole that closely receives and is anchored to said first terminal, said spring device also having a contacting end portion which has an aperture through which said second terminal extends and which forms a pair of opposite arms that extend largely in said longitudinal direction and which lie on laterally opposite sides of said second terminal, said contacting end portion having a laterally extending leg that connects said arms, with each arm extending from near said anchor end to said leg, said contacting end portion being biased to pivot in a shorting direction so said leg moves outwardly and against second terminal, with said pair of arms stabilizing the orientation of said leg, but said contacting end portions being pivotable in an opposite unshorting direction;

said base has a slot extending inwardly therein, and said spring device has a tab which is received in said slot.

21. A connector which has an insularlye base and first and second terminals that are longitudinally spaced apart and that project outwardly from a surface of said base and which are constructed to mate with terminal devices of a mating connector device which has a housing that will closely approach said base when said connectors mate, wherein said longitudinal and outward directions are normal to each other and to a lateral direction, wherein said terminals must be continually shorted except when said connector is mated to said connector device, comprising:

a spring device which is formed of sheet metal, said spring device having an anchor end with a hole that closely receives and is anchored to said first terminal, said spring device also having a contacting end portion which has an aperture through which said second terminal extends and which forms a pair of opposite arms that extend largely in said longitudinal direction and which lie on laterally opposite sides of said second terminal, said contacting end portion having a laterally extending leg that connects said arms, with each arm extending from near said anchor end to said leg, said contacting end portion being biased to pivot in a shorting direction so said leg moves outwardly and against second terminal, with said pair of arms stabilizing the orientation of said leg, but said contacting end portions being pivotable in an opposite unshorting direction;

an isolator of dielectric material surrounding a portion of said second terminal that lies beside said leg of said contact end portion when said contact end portion is pivoted in said unshorting direction to an unshorting position, said isolator having an outer end that lies inward of where said leg moves against terminal when said contact end portion pivots in said shorting direction.

* * * * *